US011905957B1

(12) United States Patent
Lee et al.

(10) Patent No.: US 11,905,957 B1
(45) Date of Patent: Feb. 20, 2024

(54) SCREW WATER PUMP WITH INNER HOUSING AND OUTER HOUSING

(71) Applicant: COAVIS, Sejong-si (KR)

(72) Inventors: Hyuntae Lee, Sejong-si (KR); Wookeun Lee, Sejong-si (KR); Yonghwa Hong, Sejong-si (KR)

(73) Assignee: COAVIS, Sejong-si (KR)

( * ) Notice: Subject to any disclaimer, the term of this patent is extended or adjusted under 35 U.S.C. 154(b) by 0 days.

(21) Appl. No.: 18/059,361

(22) Filed: Nov. 28, 2022

(51) Int. Cl.
*F04C 2/16* (2006.01)
*F04C 15/06* (2006.01)

(52) U.S. Cl.
CPC ..... *F04C 2/16* (2013.01); *F04C 15/06* (2013.01); *F04C 2210/208* (2013.01); *F04C 2240/30* (2013.01)

(58) Field of Classification Search
CPC ..... F04C 2/16; F04C 2/165
See application file for complete search history.

(56) References Cited

U.S. PATENT DOCUMENTS

2022/0333597 A1* 10/2022 Pawellek ..... B60K 11/02
2022/0344747 A1* 10/2022 Pawellek ..... H01M 10/63

FOREIGN PATENT DOCUMENTS

GB 2401396 A * 11/2004 ..... F04C 11/008
KR 102178862 B1 11/2020
KR 102195349 B1 * 12/2020
WO 2021001402 A1 1/2021

* cited by examiner

*Primary Examiner* — Laert Dounis
(74) *Attorney, Agent, or Firm* — McCoy Russell LLP

(57) ABSTRACT

Provided is a water pump having improved efficiency by simplifying its structure, the water pump including: an outer housing having a shape of a container, and including an inlet part positioned at a lower end, and an outlet part positioned at a side of an upper end; an inner housing having a shape of a container, including a communication hole positioned at an upper end and communicating the inside and outside with each other, and inserted into the outer housing; a thrust key coupled to the inside of the outer housing; and a first screw and a second screw, inserted into the inner housing, having lower ends supported by the thrust key, and engaged with each other to be rotated together.

7 Claims, 6 Drawing Sheets

[FIG. 1]
Prior Art
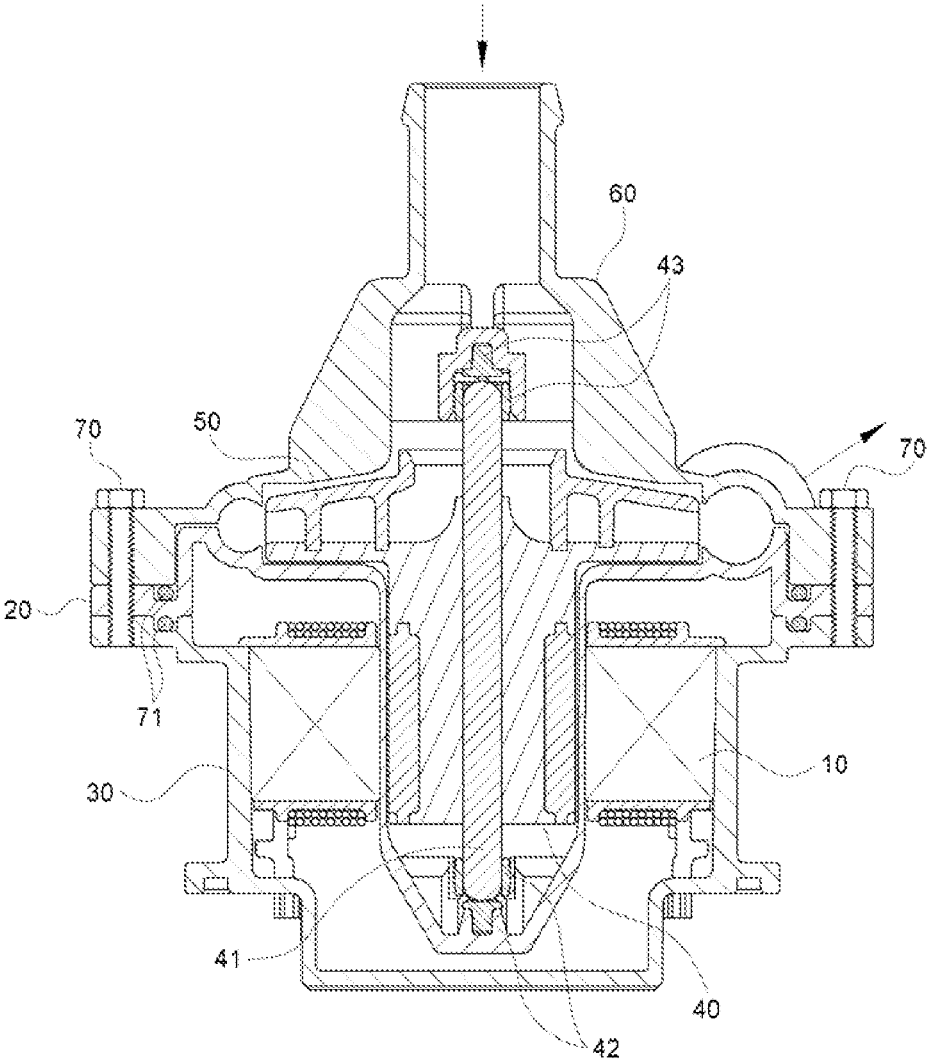

[FIG. 2]
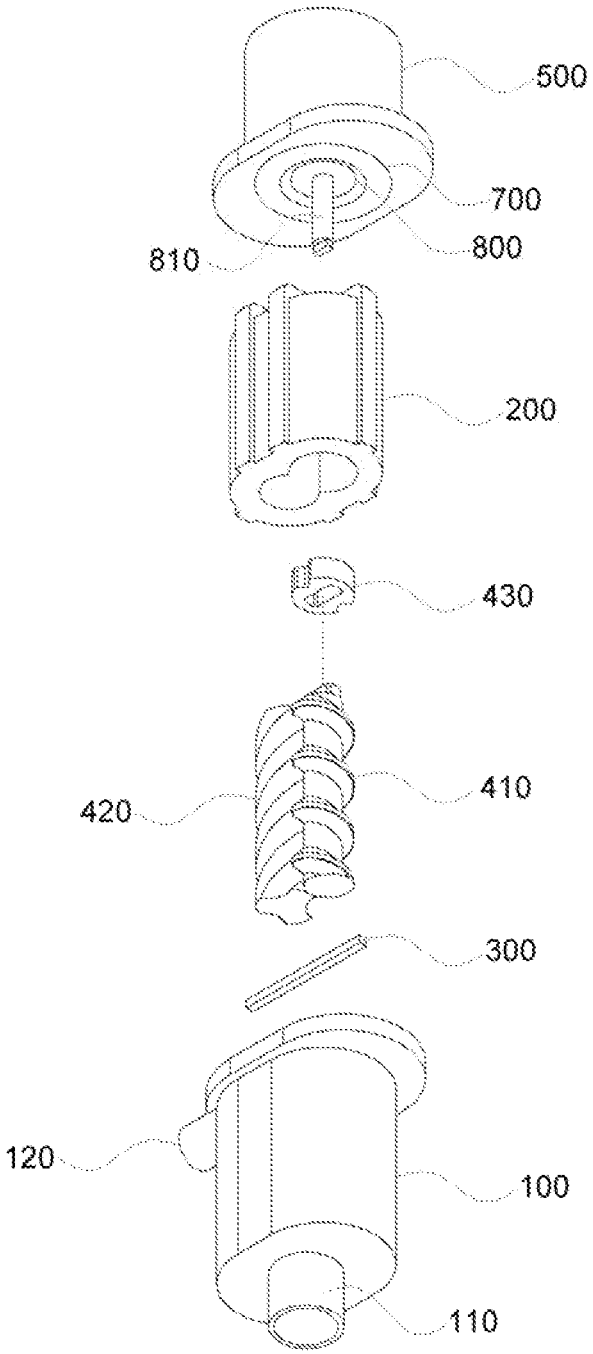

[FIG. 3]
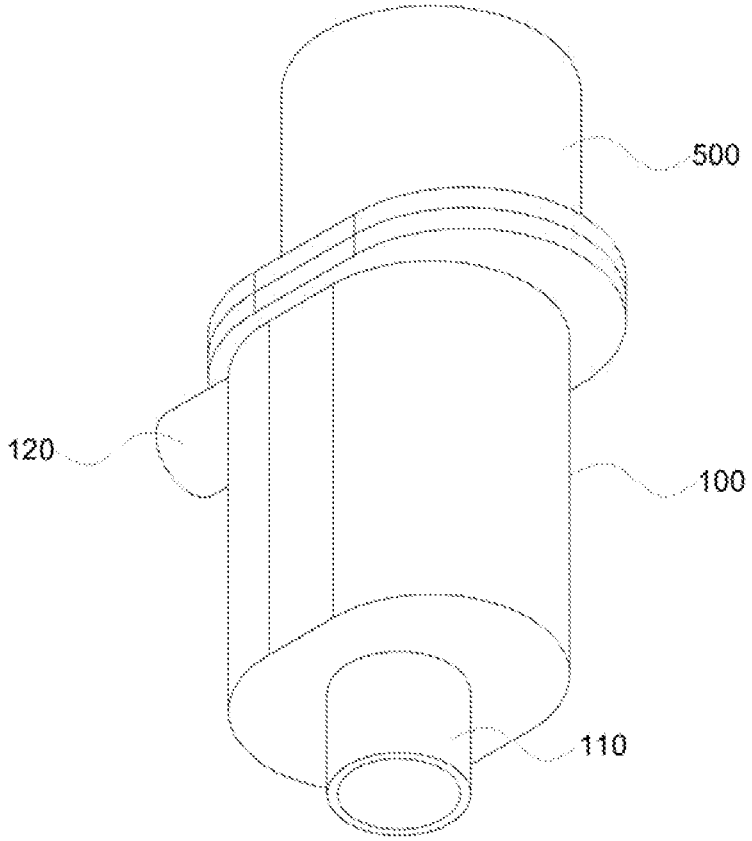

[FIG. 4]
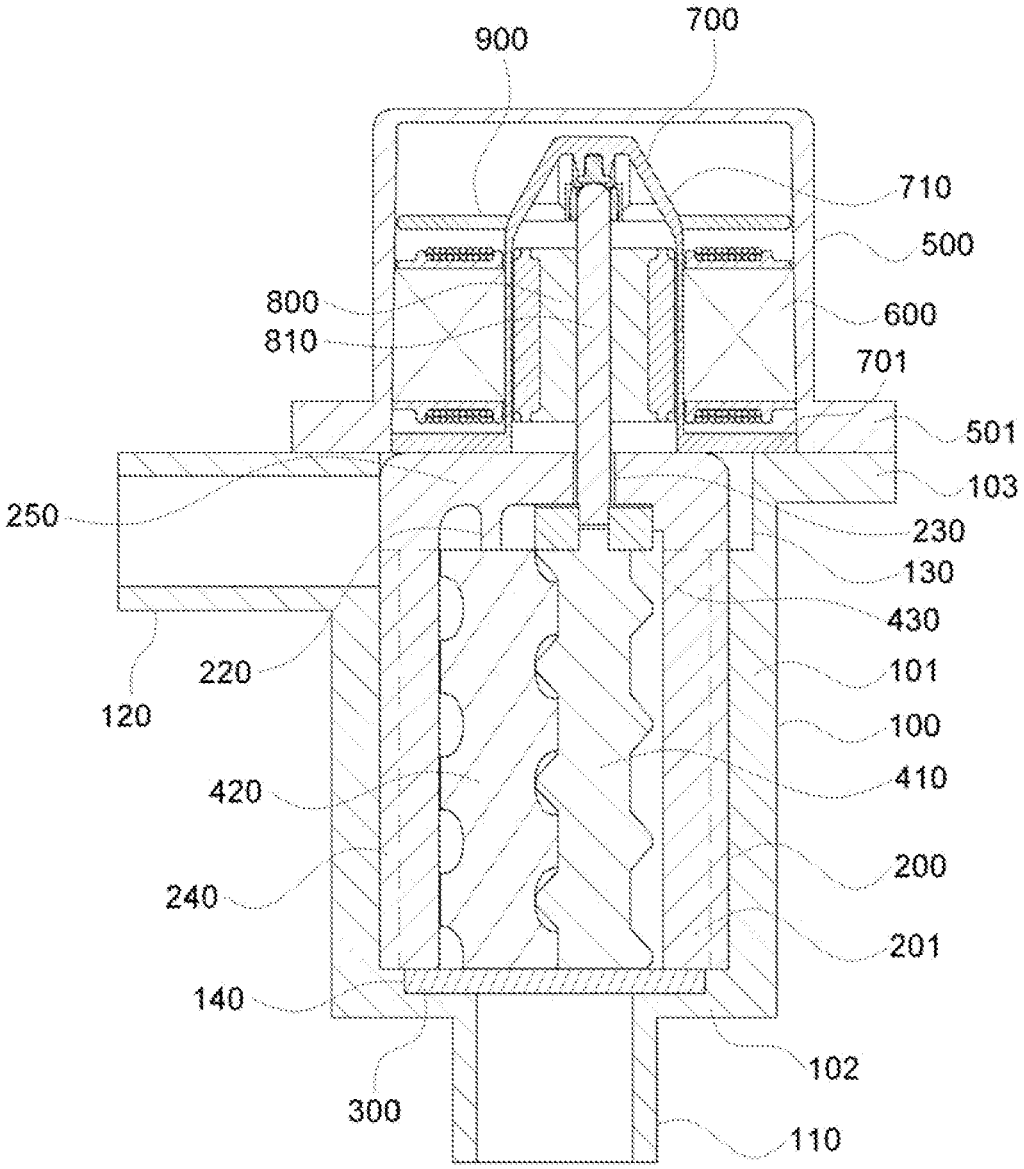

[FIG. 5]
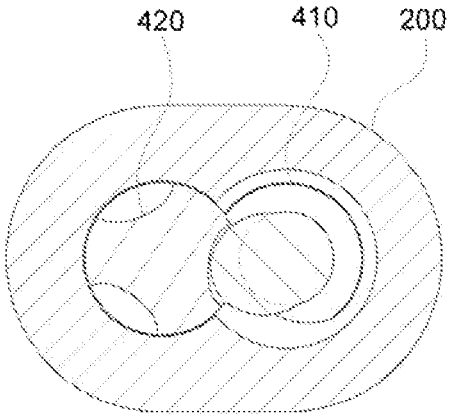

[FIG. 6]
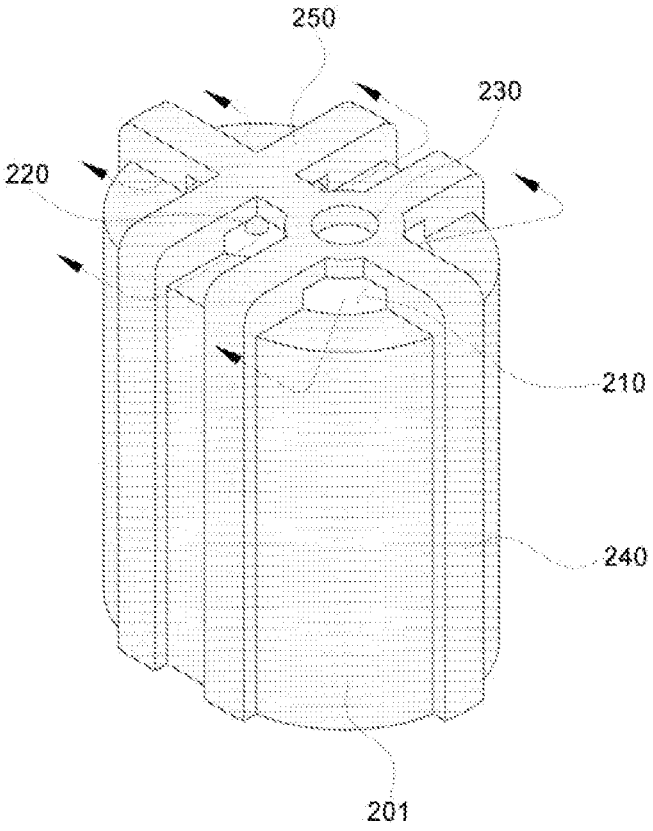

SCREW WATER PUMP WITH INNER HOUSING AND OUTER HOUSING

TECHNICAL FIELD

The following disclosure relates to a water pump that pumps cooling water in which the pump is rotated by driving the motor.

BACKGROUND

A water pump is a device for circulating cooling water to an engine or a heater for engine cooling or interior heating. This water pump may be roughly classified into a mechanical water pump and an electric water pump.

The mechanical water pump is a pump connected to a crankshaft of the engine and driven by rotation of the crankshaft, and the electric water pump is a pump driven by rotation of a motor controlled by a control device.

The electric water pump may roughly include a motor part including a housing, a stator and a rotor, and a pump part including an impeller and an impeller casing. In addition, the stator may be positioned in and fixed to the housing, the rotor may be disposed in the stator while being spaced apart therefrom, the impeller may be coupled to a rotating shaft of the rotor, and the impeller casing may be coupled to the housing to cover and block the impeller.

FIG. 1 is a front cross-sectional view showing an example of a prior electric water pump.

As shown in the drawing, the prior electric water pump may roughly include a motor housing 30, a stator 10, a lower casing 20, an upper casing 60, an impeller 50, and a rotor 40. The motor housing 30 may have a shape of a concave container with an open upper side, the stator 10 may be inserted into the motor housing 30, the lower casing 20 may be coupled to an upper side of the motor housing 30, a rotor accommodating part of the lower casing 20 may thus be inserted through a hollow interior of the stator 10. In addition, the rotor 40 may be inserted into the rotor accommodating part, the impeller 50 may be disposed on an upper side of the rotor 40, and the rotor 40 and the impeller 50 are integrally coupled with each other. In addition, the upper casing 60 may be coupled to an upper side of the lower casing 20, and the impeller 50 may be disposed in an impeller accommodating space, which is an internal space formed by the coupling of the lower casing 20 and the upper casing 60. In addition, a lower end of the rotating shaft 41 of the rotor 40 may be rotatably coupled to a lower bearing 42 and an upper end of the rotating shaft 41 may be rotatably coupled to an upper bearing 43.

However, the pump part of this prior electric water pump pumps cooling water by using a high-speed rotation of the impeller, which may lead to complex structures of the impeller and the upper and lower casings surrounding the impeller. In addition, the rotating shaft of the rotor is rotatably coupled to the upper casing. Such a structure may thus require bearings not only for a bearing mounting part but also for a bushing, a thrust pin, or the like that is coupled to the bearing mounting part, which results in more components and a complicated structure. In addition, the bearing housing is disposed adjacent to an inlet into which cooling water is introduced, and the water pump may thus have lower efficiency due to a flow resistance of cooling water. In addition, the impeller has a larger outer diameter, and there is thus a limit to reducing a size of the water pump in a diameter direction.

RELATED ART DOCUMENT

Patent Document

KR 10-2178862 B1 (Nov. 9, 2020) entitled, "Electric water pump"

SUMMARY

Embodiments of the present disclosure are directed to providing a water pump having improved efficiency by simplifying a structure of a pump part and smoothly discharging cooling water.

Embodiments of the present disclosure are directed to providing a water pump having a slim and compact structure by a smaller outer diameter of the pump part.

In one general aspect, a water pump includes: an outer housing having a shape of a container with an open upper side, and including an inlet part positioned at a lower end and communicating with an inner space for a fluid to be introduced therein, and an outlet part positioned at a side of an upper end and communicating with the inner space for the fluid to be discharged therethrough; an inner housing having a shape of a container with an open lower side, including a communication hole positioned at an upper end and communicating the inside and outside with each other, and inserted into the outer housing for the communication hole to communicate with the outlet part; a thrust key inserted into and coupled to an inner lower end of the outer housing; and a first screw and a second screw, inserted into the inner housing, having lower ends supported by the thrust key, and engaged with each other to be rotated together.

A plurality of communication holes may be positioned in the inner housing, and the plurality of communication holes may be spaced apart from each other along a circumference of the upper end of the inner housing, and positioned toward the upper and lateral sides.

A passage groove communicating with the outlet part may be positioned in an upper end of a first side wall of the outer housing along its circumference to correspond to the plurality of communication holes.

A plurality of ribs may protrude from an outer surface of a second side wall of the inner housing in a vertical direction, and the plurality of ribs may be spaced apart from each other along a circumference of the second side wall.

The upper end of the inner housing may include an upper frame having a shape of a skeleton in which parts other than the plurality of communication holes are connected with each other, and the upper frame may be integrally connected with the plurality of ribs.

A support pin may protrude from an inner upper end of the inner housing toward the second screw.

A key insertion groove may be positioned in an inner bottom of the outer housing, and the thrust key may be inserted into and coupled to the key insertion groove.

The pump may further include a motor part coupled to the upper side of the outer housing to cover and block the open upper side of the outer housing, and including a driving shaft passing through the inner housing and connected to the first screw.

The motor part may include: a motor cover having a shape of a container with an open lower side; a stator inserted into and coupled to the motor cover; a rotor casing including a rotor accommodating part that protrudes upward, has a rotor accommodating space concave upward from a lower surface thereof, and is inserted into the stator, and coupled to a lower end of the motor cover; and a rotor including the driving shaft connected to the first screw, and positioned in the rotor accommodating space of the rotor accommodating part for an upper end of the driving shaft to be rotatably coupled to the rotor casing.

The rotor accommodating space may communicate with the inside of the inner housing through the communication hole.

Other features and aspects will be apparent from the following detailed description, the drawings, and the claims.

BRIEF DESCRIPTION OF THE DRAWINGS

FIG. 1 is a front cross-sectional view showing an example of a prior electric water pump.

FIGS. 2 to 4 are an exploded perspective view, an assembled perspective view, and a front cross-sectional view showing a water pump according to an embodiment of the present disclosure, respectively.

FIG. 5 is a plan cross-sectional view showing a cross-section of the water pump cut in a horizontal direction according to an embodiment of the present disclosure.

FIG. 6 is a perspective view showing an inner housing of the water pump according to an embodiment of the present disclosure.

DETAILED DESCRIPTION OF EMBODIMENTS

Hereinafter, a water pump of the present disclosure is described in detail with reference to the accompanying drawings.

FIGS. 2 to 4 are an exploded perspective view, an assembled perspective view, and a front cross-sectional view showing a water pump according to an embodiment of the present disclosure, respectively.

As shown in the drawings, the water pump according to an embodiment of the present disclosure may roughly include an outer housing 100, an inner housing 200, a thrust key 300, a first screw 410, and a second screw 420. In addition, the water pump according to an embodiment of the present disclosure may further include a motor part.

The outer housing 100 may have a shape of a container with an open upper side. For example, the outer housing 100 may include a first side wall 101, a first bottom wall 102, and a first flange 103. The first side wall 101 may have a tubular shape, an empty space inside, and an open upper end, and the first flange 103 may extend outward from the upper end of the first side wall 101. The first side wall 101 may have a lower end blocked by the first bottom wall 102. The first bottom wall 102 may have an inlet passing through both upper and lower surfaces, and an inlet part 110 extending downward from a circumference of the inlet. An outlet may be positioned at the upper end of the first side wall 101 and pass through the inner and outer surfaces thereof in the lateral direction, and an outlet part 120 may extend outward from a circumference of the outlet. A key insertion groove 140 may be positioned in the inner first bottom wall 102 of the outer housing 100.

The inner housing 200 may have a shape of a container with an open lower side. For example, the inner housing 200 may include a second side wall 201 and an upper frame 250. The second side wall 201 may have a cylindrical shape and an empty inside, the second side wall 201 may have an open lower end, and an upper frame 250 having a skeleton shape may be attached to an upper end of the second side wall 201. A plurality of communication holes 210 may be positioned between structures included in the upper frame 250, and communicate the inside and outside of the structures with each other. The plurality of communication holes 210 may be spaced apart from each other along a circumference of the upper end of the second side wall 201, and the plurality of communication holes 210 may each be open toward the upper and lateral sides. In addition, the inside of the inner housing 200 may have a shape corresponding to a shape in which the first screw 410 and the second screw 420 are engaged with each other. In addition, the inner housing 200 may be inserted downward from the open upper side of the outer housing 100, the lower end of the inner housing 200 may be supported in contact with an inner surface of the first bottom wall 102 of the outer housing 100, and an upper end of the inner housing 200 may have the same height as that of an upper end of the outer housing 100. In addition, an outer side of the inner housing 200 may not be shaken by being contact-coupled with an inner surface of the first side wall 101 of the outer housing 100. In addition, the communication holes 210 of the inner housing 200 may communicate with the outlet part 120 of the outer housing 100 in the state where the inner housing 200 is inserted into and coupled to the outer housing 100. In addition, through-holes 230 may be positioned in the upper frame 250 of the inner housing 200 and pass through both upper and lower surfaces thereof, and a driving shaft 810 of the motor part may be inserted through the through-holes 230.

The thrust key 300 may be inserted into the key insertion groove 140 and fixed to the outer housing 100. The thrust key 300 may serve to support lower ends of the first and second screws 410 and 420, and the first screw 410 and the second screw 420 may be smoothly rotated while being supported by the thrust key 300. The thrust key 300 may have a rectangular cross section, and have a rectangular bar shape having a longer length than the thickness and width thereof. The thrust key 300 may be inserted downward from the open upper side of the outer housing 100, and the thrust key 300 may be inserted into the key insertion groove 140 and fixed to the outer housing 100.

The first screw 410 may be a male screw in which helical protrusions protrude along an outer circumferential surface of its rotating shaft. An upper end of the first screw 410 may be coupled to the driving shaft 810 of the motor part, the first screw 410 and the driving shaft 810 may be coupled with each other through a coupling 430 or the like, and the driving shaft 810 and the first screw 410 may thus be rotated together.

The second screw 420 may be a female screw in which concave helical grooves are positioned along an outer circumferential surface of its rotating shaft, the helical groove of the second screw 420 may have a shape corresponding to that of the helical protrusion of the first screw 410, and the first screw 410 and the second screw 420 may thus be engaged with each other to be rotated together.

The motor part may cover and block the open upper side of the outer housing 100, and a lower end of the motor part may be contact-coupled to the upper end of the outer housing 100. In addition, a lower end of the driving shaft 810 of the motor part may be connected to the first screw 410 through the through hole 230 positioned in the upper frame 250 of the inner housing 200.

Therefore, when the motor part is operated to rotate the driving shaft 810, the first screw 410 and the second screw 420 connected thereto may be rotated to pump a fluid. The fluid suctioned through the inlet 110 may flow from bottom to top between the first screw 410 and the second screw 420, and the fluid discharged from the upper ends of the first and second screws 410 and 420 may be delivered to the outside through the outlet part 120 via the communication hole 210.

Accordingly, the water pump of the present disclosure may have improved efficiency by simplifying its structure and smoothly discharging cooling water. In addition, the water pump of the present disclosure may have a pump part which is a screw type and thus has an outer diameter smaller than that of another water pump using the impeller, and thus be manufactured to have a slim and compact structure.

In addition, a passage groove 130 communicating with the outlet part 120 may be positioned in the upper end of the outer housing 100 along its circumference to correspond to the plurality of communication holes 210. Here, the concave passage groove 130 may be continuously positioned in the inner surface of the outer housing 100 along the circumference. That is, the fluid passed through the plurality of communication holes 210 may flow along the groove passage 130 to be delivered to the outside through the outlet part 120. In this way, the fluid may more smoothly flow, thereby improving the efficiency of the water pump.

In addition, a plurality of ribs 240 may protrude from an outer surface of the second side wall 201 of the inner housing 200 in the vertical direction, and the plurality of ribs 240 may be spaced apart from each other along a circumference of the second side wall 201. Therefore, when the inner housing 200 is inserted into and coupled to the outer housing 100, only outer surfaces of the plurality of ribs 240 of the inner housing 200 may be in contact with the inner surface of the first side wall 101 of the outer housing 100. Accordingly, the inner housing 200 may be very easily inserted into the outer housing 100 due to a reduced frictional force even when there is an assembly tolerance or dimensional error. In addition, the plurality of ribs 240 may reinforce a structural strength of the inner housing 200, thereby reducing deformation and damage of the inner housing 200.

In addition, the upper frame 250 of the inner housing 200 may be integrally connected with the plurality of ribs 240. That is, the upper frame 250 of the inner housing 200 may be the skeleton-shaped structure with a smaller thickness, and it is thus possible to reinforce a structural strength of the upper frame 250 by integrally forming the upper frame 250 connected to the plurality of ribs 240 through injection or the like by using resin.

In addition, the inner housing 200 may include a support pin 220 protruding from the lower surface of the upper frame 250, which is an inner upper end of the inner housing, toward the second screw 420. The support pin 220 may serve to allow the second screw 420 to be smoothly rotated while supporting the upper end of the second screw 420. In addition, a lower end of the support pin 220 may be disposed adjacent to or opposite to an upper surface of the second screw 420.

In addition, the motor part may include a motor cover 500, a stator 600, a rotor casing 700, and a rotor 800.

The motor cover 500 may have a shape of a container with an open lower side. For example, the motor cover 500 may have a shape of a hat with an empty space inside, and accommodate the stator 600, the rotor casing 700, and the rotor 800 therein. In addition, the motor cover 500 may include a second flange 501 externally extending from its lower end, and the motor cover 500 may be coupled to the outer housing 100, i.e., coupled to the upper end of the outer housing 100 to cover and block the upper sides of the outer housing 100 and the inner housing 200. Here, the second flange 501 of the motor cover 500 may be formed to correspond to the first flange 103 of the outer housing 100, and the second flange 501 and the first flange 103 may be coupled with each other by a fastening means or the like. The stator 600 may be a stator used in a general motor and including a core, an insulator, and a coil, and the stator 600 may be inserted into and coupled to the motor cover 500. The rotor casing 700 may include a rotor accommodating part 710 that protrudes upward and has a rotor accommodating space concave upward from a lower surface thereof, and a third flange 701 may extend externally from the lower end of the rotor accommodating part 710. In addition, the rotor casing 700 may be inserted into and coupled to the motor cover 500 in such a manner that the rotor accommodating part 710 is inserted into a hollow of the stator 600, and the third flange 701 blocks the open lower side of the motor cover 500. Here, the lower end and flange of the rotor casing 700 may be supported in contact with at least one of the upper ends of the inner housing 200 and the outer housing 100. The rotor 800 may be a rotor used in the general motor and including a core, a permanent magnet, and a driving shaft, and in the rotor 800, an upper end of the driving shaft 810 may be rotatably coupled to an upper end of the rotor accommodating part 710. In addition, the lower end of the driving shaft 810 may pass through the upper frame 250 of the inner housing 200 and be connected to the first screw 410. In addition, components included in the motor part may have various shapes.

In addition, the rotor accommodating space positioned inside the rotor casing 700 may communicate with the inside of the inner housing 200 through the plurality of communication holes 210. Therefore, the motor part may be cooled while the fluid partially flows between the rotor 800 of the motor part and the rotor accommodating part 710.

In addition, the motor part may further include a control board 900 for controlling driving of the motor. The control board 900 may be positioned inside the motor cover 500, and the control board 900 may be disposed on an upper side of the stator 600 and electrically connected to the stator 600.

As set forth above, the water pump of the present disclosure may have the improved efficiency by simplifying the structure of the pump part and smoothly discharging cooling water.

The water pump may also be manufactured to have the slim and compact structure by the smaller outer diameter of the pump part.

The present disclosure is not limited to the above-described embodiments, and may be variously applied. In addition, the present disclosure may be variously modified by those skilled in the art to which the present disclosure pertains without departing from the gist of the present disclosure claimed in the claims.

What is claimed is:

1. A water pump comprising:

an outer housing having a shape of a container with an open upper side, and including an inlet part positioned at a lower end and communicating with an inner space for a fluid to be introduced therein, and an outlet part positioned at a side of an upper end and communicating with the inner space for the fluid to be discharged therethrough;

an inner housing having a shape of a container with an open lower side, including a communication hole positioned at an upper end and communicating the inside and outside of the inner housing with each other, and inserted into the outer housing for the communication hole to communicate with the outlet part;

a thrust key inserted into and coupled to an inner lower end of the outer housing; and a first screw and a second screw, inserted into the inner housing, having lower ends supported by the thrust key, and engaged with each other to be rotated together, wherein a plurality of communication holes are positioned in the inner housing, and the plurality of communication holes are spaced apart from each other along a circumference of the upper end of the inner housing, and positioned toward the upper and lateral sides, a plurality of ribs protrude from an outer surface of a second side wall of the inner housing in a vertical direction, and the plurality of ribs are spaced apart from each other along a circumference of the second side wall, the upper end of the inner housing includes an upper frame having a shape of a skeleton in which parts other than the plurality of communication holes are connected with each other, and the upper frame is integrally connected with the plurality of ribs.

2. The water pump of claim 1, wherein a passage groove communicating with the outlet part is positioned in an upper end of a first side wall of the outer housing along its circumference to correspond to the plurality of communication holes.

3. The water pump of claim 1, wherein a support pin protrudes from an inner upper end of the inner housing toward the second screw.

4. The water pump of claim 1, wherein a key insertion groove is positioned in an inner bottom of the outer housing, and the thrust key is inserted into and coupled to the key insertion groove.

5. The water pump of claim 1, further comprising a motor part coupled to the upper side of the outer housing to cover and block the open upper side of the outer housing, and including a driving shaft passing through the inner housing and connected to the first screw.

6. The water pump of claim 5, wherein the motor part includes:

a motor cover having a shape of a container with an open lower side;

a stator inserted into and coupled to the motor cover;

a rotor casing including a rotor accommodating part that protrudes upward, has a rotor accommodating space concave upward from a lower surface thereof, and is inserted into the stator, and coupled to a lower end of the motor cover; and a rotor including the driving shaft connected to the first screw, and positioned in the rotor accommodating space of the rotor accommodating part for an upper end of the driving shaft to be rotatably coupled to the rotor casing.

7. The water pump of claim 6, wherein the rotor accommodating space communicates with the inside of the inner housing through the plurality of communication holes.

* * * * *